US009249698B2

(12) United States Patent
Gustafson et al.

(10) Patent No.: US 9,249,698 B2
(45) Date of Patent: Feb. 2, 2016

(54) COMPRESSION RELIEF BRAKE RESET MECHANISM

(71) Applicant: Cummins Inc., Columbus, IN (US)

(72) Inventors: Richard Gustafson, Columbus, IN (US); Bradford Lynch, Chicago, IL (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 14/718,415

(22) Filed: May 21, 2015

(65) Prior Publication Data

US 2015/0252694 A1 Sep. 10, 2015

Related U.S. Application Data

(63) Continuation of application No. PCT/US2013/072206, filed on Nov. 27, 2013.

(60) Provisional application No. 61/730,395, filed on Nov. 27, 2012.

(51) Int. Cl.

| | |
|---|---|
| ***F01L 13/06*** | (2006.01) |
| ***F01L 13/00*** | (2006.01) |
| ***F01L 9/02*** | (2006.01) |
| ***F01L 1/18*** | (2006.01) |
| ***F02D 13/04*** | (2006.01) |

(52) U.S. Cl.

CPC ..... *F01L 13/0031* (2013.01); *F01L 1/181* (2013.01); *F01L 9/023* (2013.01); *F01L 13/06* (2013.01); *F01L 13/065* (2013.01); *F02D 13/04* (2013.01)

(58) Field of Classification Search

CPC ..... F02D 13/04; F01L 9/023; F01L 9/025; F01L 13/0031; F01L 13/06; F01L 13/065

See application file for complete search history.

(56) References Cited

U.S. PATENT DOCUMENTS

| | | | | |
|---|---|---|---|---|
| 5,829,397 | A * | 11/1998 | Vorih | F01L 1/181 123/198 D |
| 6,253,730 | B1 * | 7/2001 | Gustafson | F01L 13/06 123/321 |
| 6,450,144 | B2 * | 9/2002 | Janak | F01L 1/181 123/321 |
| 6,691,674 | B2 | 2/2004 | McCarthy et al. | |
| 6,883,492 | B2 * | 4/2005 | Vanderpoel | F01L 1/08 123/321 |
| 8,065,987 | B2 | 11/2011 | Yang | |
| 8,863,726 | B2 * | 10/2014 | Ruggiero | F02D 13/04 123/182.1 |
| 9,016,249 | B2 * | 4/2015 | Roberts | F01L 1/08 123/90.16 |
| 2003/0221663 | A1 | 12/2003 | Vanderpoel et al. | |
| 2007/0144472 | A1 * | 6/2007 | Yang | F01L 1/08 123/90.16 |

OTHER PUBLICATIONS

International Searching Authority, International Search Report issued in Application No. PCT/US2013/072206, mailed Apr. 15, 2014, 2 pp.

* cited by examiner

*Primary Examiner* — Erick Solis

(74) *Attorney, Agent, or Firm* — Taft, Stettinius & Hollister LLP

(57) ABSTRACT

An engine compression braking system having a rocker lever and reset valve assembly to operate an engine in both normal power and braking modes while effectively controlling opening and closing of the exhaust valve for compression braking. The reset valve assembly includes a reset pin mounted in a passage of the rocker arm and movement of the reset pin in the compression mode of braking is controlled by contact of the reset pin with a support shaft which the rocker arm rotates around.

16 Claims, 5 Drawing Sheets

COMPRESSION RELIEF BRAKE RESET MECHANISM

CROSS-REFERENCE TO RELATED APPLICATION

The present application claims priority to and the benefit of the filing date of U.S. Provisional App. No. 61/730,395 filed on Nov. 27, 2012, which is incorporated herein by reference in its entirety for all purposes.

TECHNICAL FIELD

This invention relates to a reset actuation device which uses a cam profile to reduce and control reset pin motion for a compression relief brake.

BACKGROUND

Compression braking is known in the art and is used for many applications, including braking heavy vehicles. Compression brakes convert an internal combustion engine cylinder to a compressor by cutting off the fuel flow and opening an exhaust valve of the cylinder near the end of the compression stroke. This allows the power generated in the piston to escape to the atmosphere, rather than continuing to power the vehicle. One type of compression braking system is shown in U.S. Pat. No. 6,253,730 to Gustafson.

An early technique for accomplishing compression braking is disclosed in U.S. Pat. No. 3,220,392 to Cummins, where a slave hydraulic piston located over an exhaust valve opens the exhaust valve near the end of the compression stroke of an engine piston with which the exhaust valve is associated. To place the engine into braking mode, solenoids are energized which cause pressurized lubricating oil to flow through a control valve, creating a hydraulic link between a master piston and a slave piston. The master piston is displaced inward by an engine element (such as a camshaft mechanism) periodically in timed relationship with the compression stroke of the engine. A typical modern compression braking system may include exhaust valves operated during the engine's power mode by an exhaust rocker lever.

The system may also include a reset valve which operates to cause the slave piston to retract after an initial opening of the exhaust valve during braking. As a result, the exhaust valve is closed prior to the end of the expansion stroke and before the hydraulic pressure drops due to a return motion of the master piston. This design advantageously avoids shock or asymmetric loading of the valve or valve crosshead by the exhaust rocker arm at the start of the main opening event of the exhaust valve following the initial opening event.

The modern compression braking system has been further improved by the system disclosed in Gustafson, wherein the engine compression braking system has an integral rocker lever and reset valve capable of effectively avoiding asymmetric loading of a valve crosshead while providing accurate and predictable compression braking. However, further improvements in this technological area are desired.

SUMMARY

Systems, apparatus, and methods are disclosed herein to improve the operation of a reset pin in a compression brake assembly.

The systems, apparatus and methods disclosed herein present an alternative approach and enhancement to the rocker lever compression brake disclosed in U.S. Pat. No. 6,253,730 to Gustafson, the entire contents of which are hereby incorporated by reference. Although the function is similar to the device disclosed in U.S. Pat. No. 6,253,730, such as shown in FIGS. 1*a* and 1*b*, the reset actuation device of the present disclosure includes a reset pin that is actuated via a cam shaped surface on the rocker shaft, such as shown in the rocker lever of FIGS. 2-11 of the present disclosure.

Controlling motion of the reset pin by the cam surface on the rocker shaft separates the reset pin motion from the base camshaft profile lift. Shorter lift reduces the reset ball total travel and allows for improved reset spring design. In addition, the cam surface can increase the lift of the reset pin after the reset event and exhaust valve closure to enhance filling of the slave piston.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION

Figure 1A:
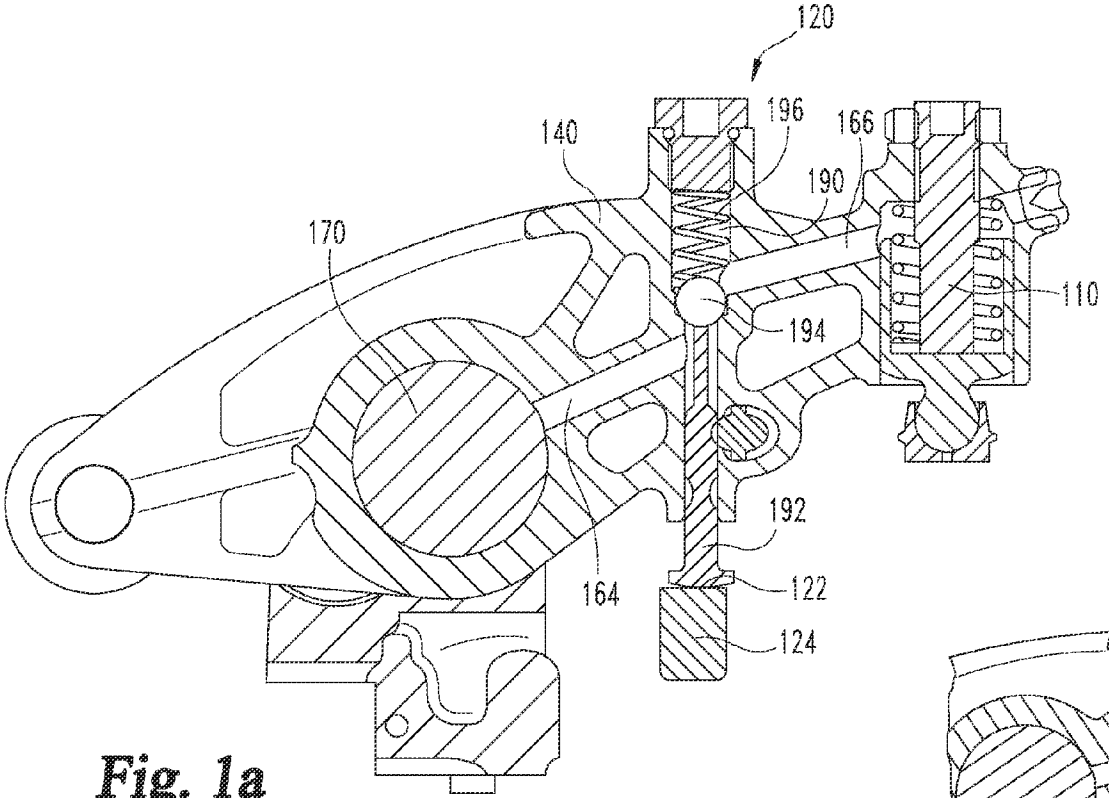
Fig. 1a (PRIOR ART)
FIGS. 1A and 1B are cross-sectional illustrations of a prior art compression relief brake reset mechanism with an integral rocker lever and reset valve operated by a reset pin in conjunction with a reset pin contact pad on a pedestal mount.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Figure 1B:
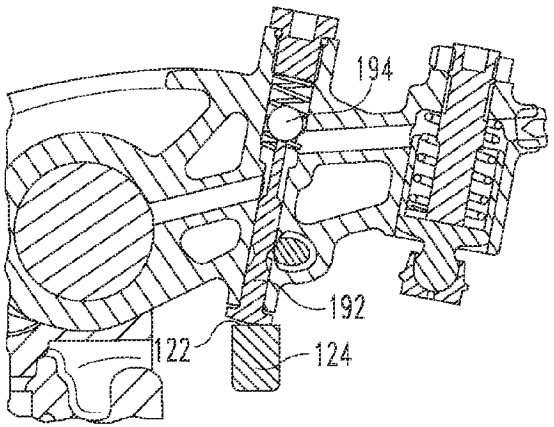
Fig. 1b (PRIOR ART)

Referring to FIGS. 1A and 1B, a compression relief braking system 120 is shown similar to that disclosed in U.S. Pat.

No. 6,253,730 to Gustafson. In this system, a rocker lever 140 is provided on a support shaft 170. Rocker lever 140 includes a reset pin 192 slidably mounted in a bore 190, where the upper end of reset pin 192 is immediately adjacent the valve seat for abutment by reset valve head 194. Reset pin 192 is positioned to contact and move valve head 194 against the force of bias spring 196. Valve head 194 is positioned to open and close bore 190, which separates low pressure fluid circuit 164 from high pressure fluid circuit 166. A reset pin contact pad 122 is mounted on an engine component, for example a pedestal 124, immediately adjacent a lower end of reset pin 192. During the initial pivoting movement of rocker lever 140, reset pin 192 will contact reset pin contact pad 122 mounted on pedestal mount 124, causing reset pin 192 to move upwardly, thereby moving reset valve head 194 off its seat from a closed position into an open position, shown in FIG. 1B. In this prior art embodiment, the amount of travel of the reset pin 192 at peak lift is shown in FIG. 1B.

Figure 2:
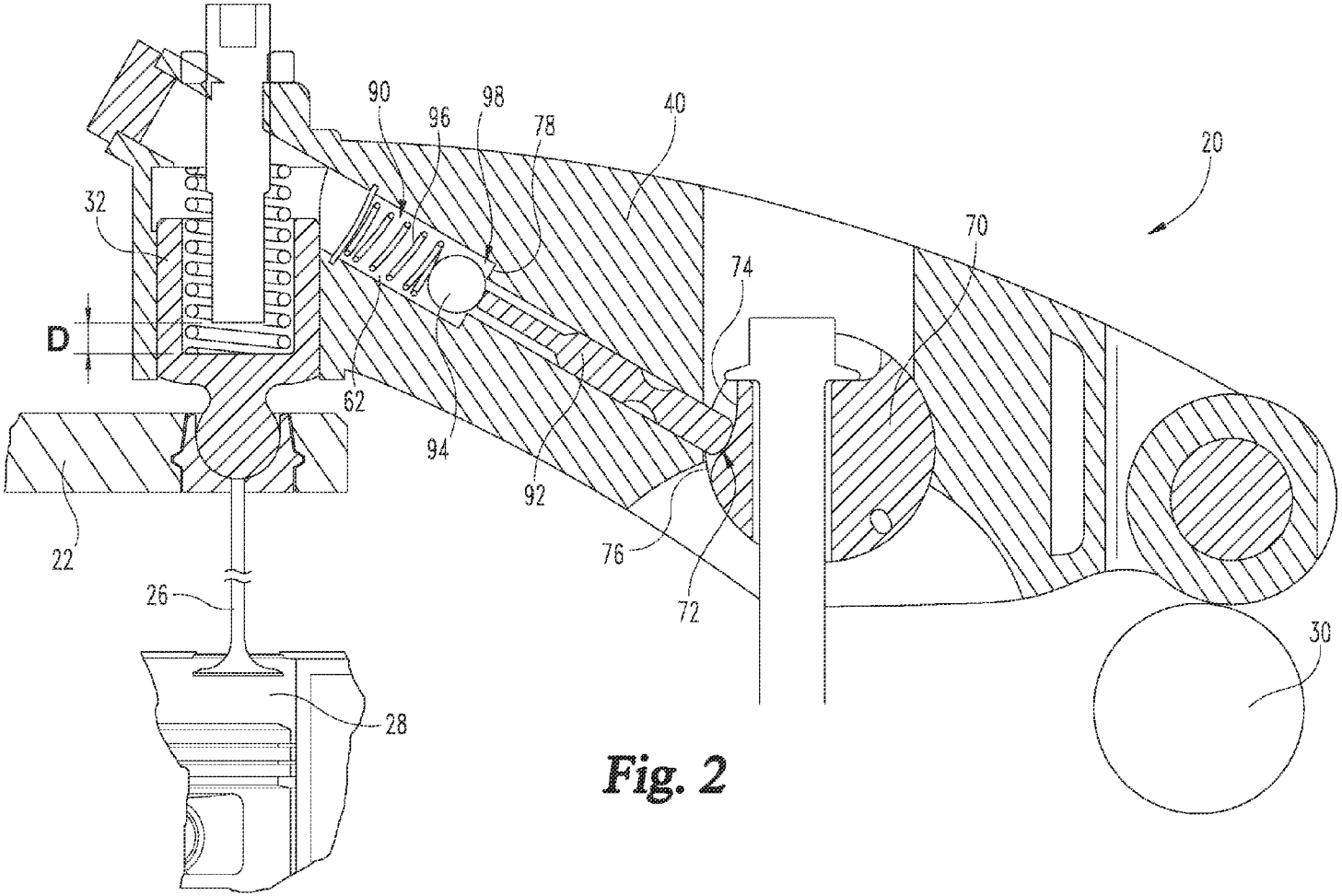
FIG. 2 is a cross-sectional illustration of a rocker lever assembly with a rocket lever connected with a cam at one end and an exhaust valve of a cylinder at an opposite end, the rocker lever being pivotally mounted about a support shaft with a cam surface that contacts a reset pin of a reset actuation device for compression relief braking.

FIG. 2 illustrates an embodiment of the compression relief brake apparatus 20 of the present invention. Apparatus 20 includes a rocker lever 40 operably connected at one end to a cam 30 that pivots or rotates rocker lever 40 about a support shaft 70 to control opening and closing of at least one exhaust valve 26 of engine cylinder 28. A reset valve assembly 90 is housed in an obliquely oriented bore 98 of the rocker lever 40, and a portion of bore 98 also serves as a fluid passage 62. Passage 62 is in flow communication with a slave piston 32, which is coupled to exhaust valve 26, and a fluid supply 86. Slave piston 32 reciprocates between a lower position, in which exhaust valve 26 is open and an upper position, in which exhaust valve 26 is closed, the distance between the lower and upper positions of slave piston 32 is represented schematically as a distance D in FIG. 2. Slave piston 32 may also be connected to crosshead 22 that is connected to a second exhaust valve of cylinder 28.

Reset valve assembly 90 includes a reset pin 92 slidably mounted in bore 98, where a second or upper end of reset pin 92 is immediately adjacent the valve seat 78 for abutment by reset valve head 94. In the illustrated embodiment, reset valve head 94 is a ball valve, although other valve types are not precluded. Reset pin 92 is positioned to contact and move valve head 94 against the force of bias spring 96. When the reset valve 90 is in the closed position, with reset valve head 94 seated in the valve seat 78, fluid is trapped in the slave piston 32 under high pressure, which enables slave piston 32 to hold exhaust valve 26 open, which in turn enables a compression brake event in a compression braking mode of operation.

Figure 3:
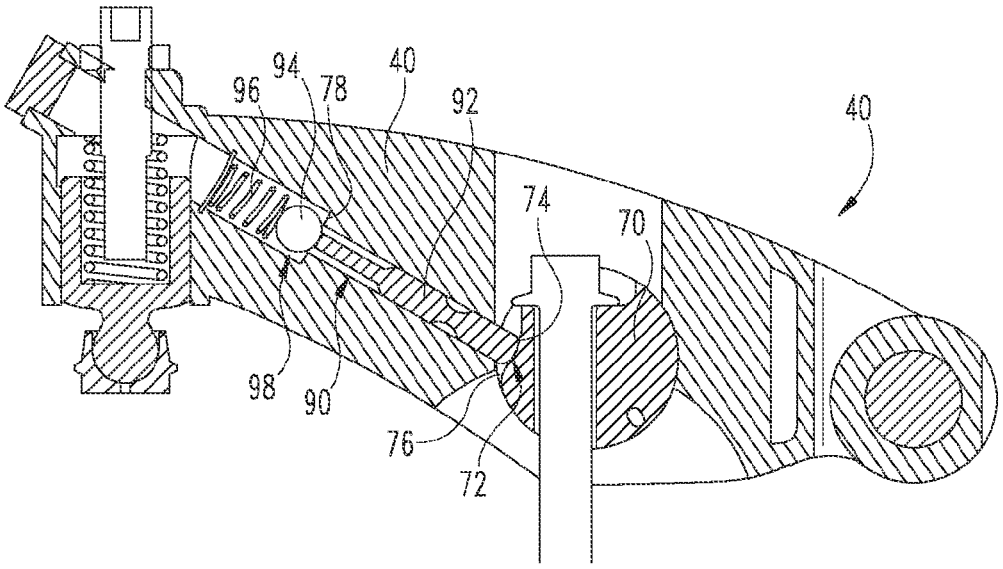
FIG. 3 is a cross-sectional illustration of the rocker lever of FIG. 2 with the position of the rocker lever and reset pin at zero lift.
Figure 4:
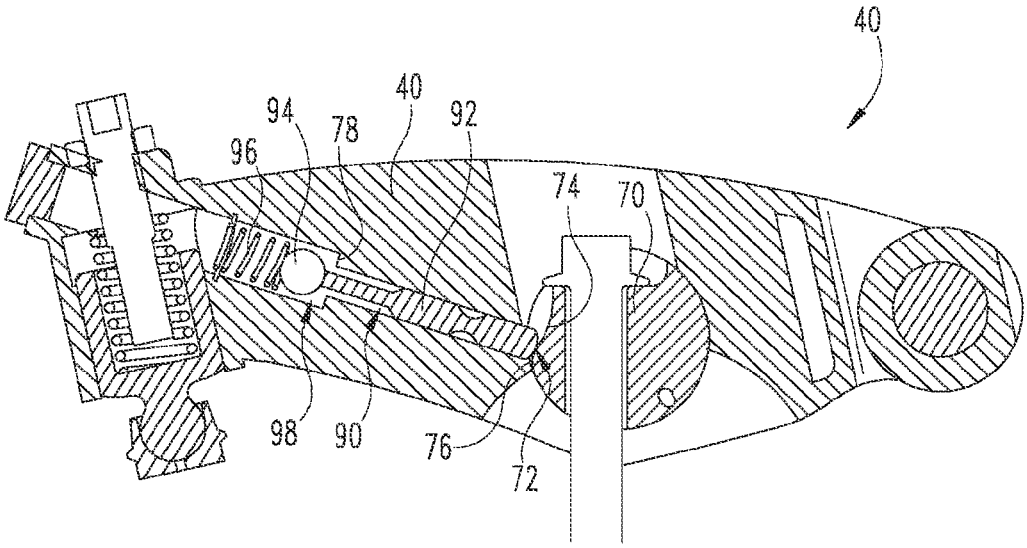
FIG. 4 is a cross-sectional illustration of the rocker lever of FIG. 2 with the position of the rocker lever and reset pin at peak lift.

FIGS. 3 and 4 show the effect on reset pin 92 of the rotation or pivoting of rocker lever 40 around support shaft 70. Cam surface 72 of support shaft 70 has a concave surface portion 74 and a convex surface portion 76. It should be understood that other profiles of cam surface 72 are also possible in order to achieve the objectives stated herein. When in a compression braking mode of operation, cam surface 72 of support shaft 70 contacts a first end of reset pin 92 and rotation of rocker lever 40 around support shaft 70 causes movement of the first end of reset pin 92 along cam surface 72. When the first end of reset pin 92 is in contact with the concave surface portion 74 of support shaft 70, the position of the second end of reset pin 92 adjacent valve head 94 allows valve head 94 to be seated against the valve seat 78, in a closed position, as shown in FIG. 3. When the first end of reset pin 92 is in contact with the convex surface portion 76 of support shaft 70, the second end of reset pin 92 pushes valve head 94 off of valve seat 78 to an open position, overcoming the force of the reset valve bias spring 96 and any force due to a difference in hydraulic pressure on either side of the valve head 94, as shown in FIG. 4.

Figure 5:
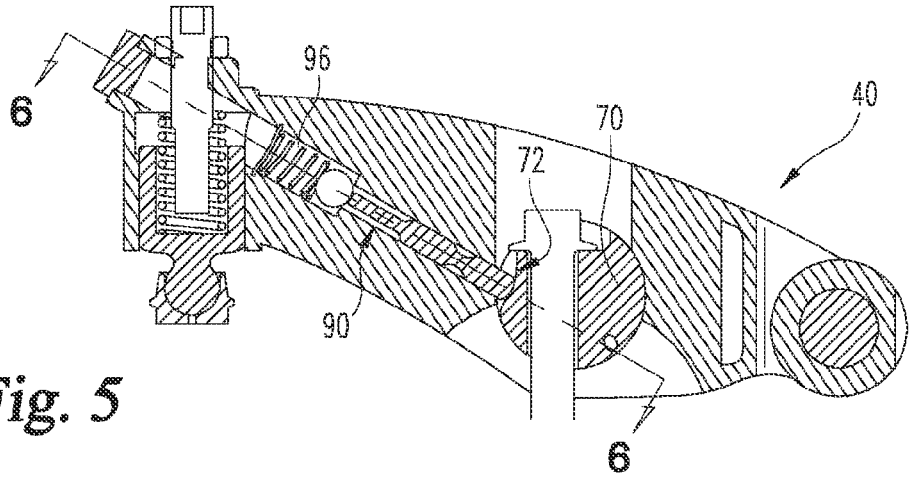
FIG. 5 is a cross-sectional illustration of the rocker lever of FIG. 2.
Figure 6:
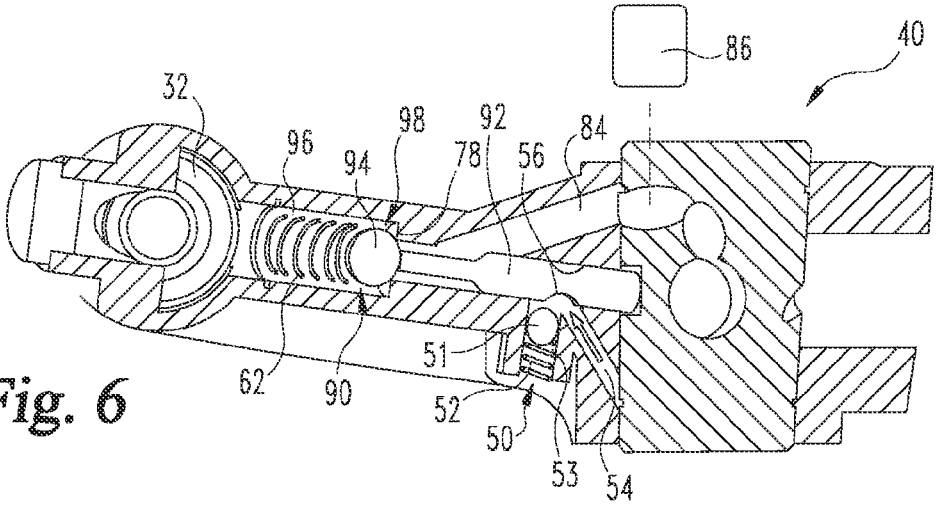
FIG. 6 is a cross sectional view of the rocker lever along line 6-6 of FIG. 5 with reset pin in the brake on position.
Figure 7:
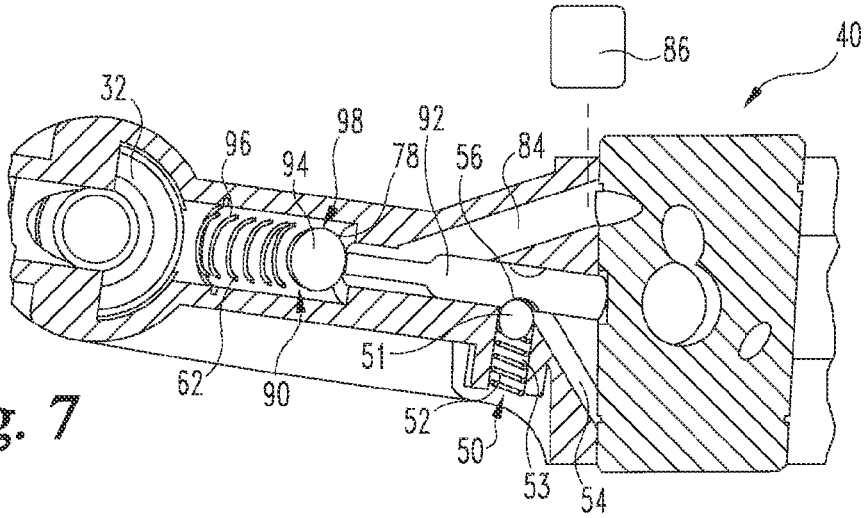
FIG. 7 is the cross sectional view of the rocker lever of FIG. 6 with reset valve in the brake off position.

FIG. 5 is a cross sectional illustration of the rocker lever 40 in a closed position with valve head 94 against valve seat 78. FIG. 6 is a cross sectional view of the rocker lever 40 along line 6-6 of FIG. 5 with the reset valve assembly 90 in the brake on position. A detent mechanism 50 includes a detent ball 51 and corresponding spring 52, which are arranged within a receptacle 53 of rocker lever 40, which is transverse to bore 98 housing reset pin 92. There is a recess 56 around reset pin 92, which provides a seat for detent ball 51 to lock reset pin 92 in an open position when compression braking mode is off, as shown in FIG. 7. In an open position, fluid flows from slave piston 32 through fluid passage 62 of bore 98 to and from a fluid supply passage 84 that is connected to a fluid supply 86. When a compression braking mode of operation is on, as shown in FIG. 6, a control fluid pressure 54 pushes detent ball 51 away from recess 56 on the side of reset pin 92. When detent ball 51 is not seated in recess 56, reset pin 92 can move freely in bore 98 under bias of spring 96 and in response to a position of cam surface 72 of support shaft 70 relative to the first end of reset pin 90 when rocker lever 40 rotates around support shaft 70. This allows reset valve head 94 to seat, thereby sealing to valve seat 78 and trapping fluid in slave piston 32, enabling a compression braking event. It should be noted that in an alternative embodiment, detent ball 51 may be alternatively replaced by a cylindrical detent as disclosed in U.S. Pat. No. 6,253,730 to Gustafson.

FIG. 7 shows the position of detent ball 51 and corresponding spring 52 when compression braking mode is off. In this mode control fluid pressure 54 is reduced so detent ball 51 is spring biased into engagement with reset pin recess 56. Reset pin 92 is thereby locked into a position where it is pushing reset valve head 94 off the valve seat 78 and maintaining the valve head 94 in an open position, regardless of the motion of rocker lever 40 around support shaft 70. This does not allow fluid pressure to build up in slave piston 32, allowing exhaust valve 26 to open and close freely in response to the movement of rocker lever 40 in normal operation.

Figure 10:
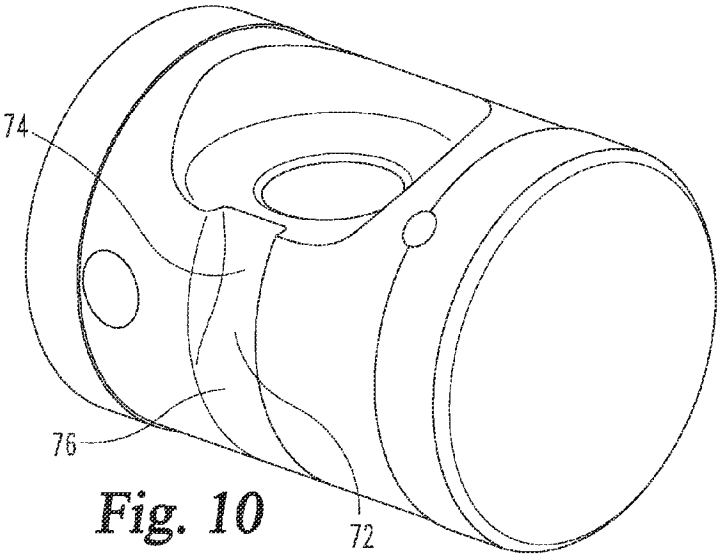
FIG. 10 is a perspective view of the support shaft of the rocker lever.
Figure 11:
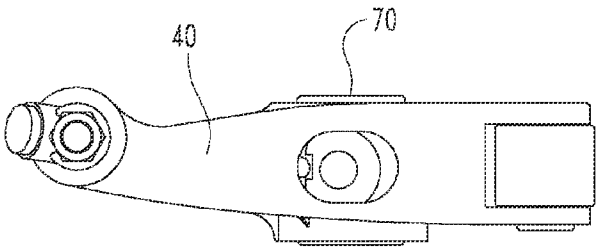
FIG. 11 is a top elevation view of the rocker lever.
Figure 8:
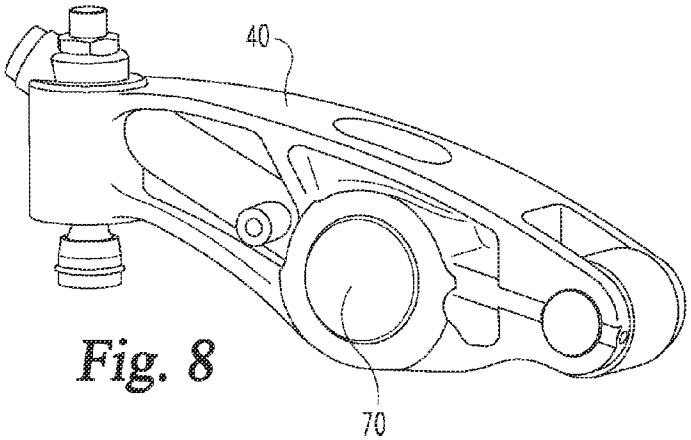
FIGS. 8 and 9 are perspective view illustrations of the rocker lever.
Figure 9:
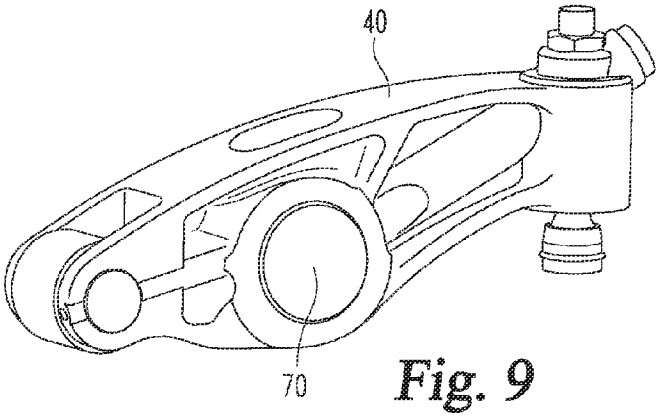

FIGS. 8-9 are perspective view illustrations of the rocker lever 40 mounted to support shaft 70. FIG. 10 is a perspective view of the rocker lever support shaft 70 showing cam surface 72 formed into an outer surface of support shaft 70 to define concave and convex cam surface portions 74, 76. FIG. 11 is a top elevation view of the rocker lever 40 mounted about support shaft 70.

The present invention described above advantageously permits the lift of reset pin 92 to be limited as desired by the cam surface 72 formed on support shaft 70. This has the further advantage of reducing the design requirements of the reset valve bias spring 96. Moreover, the present brake reset mechanism incorporates an initial negative curvature 74 on the cam surface 72, which lowers stress when lifting the reset valve head 94 off of the valve seat 78 at high brake cavity pressures at the start of the reset operation.

Many aspects of the present invention are envisioned. For example, one aspect is directed to a system comprising a compression relief brake apparatus with a rocker lever pivotally mounted on a support shaft with a cam surface and a reset valve assembly. The rocker lever is connected to an exhaust valve of an internal combustion engine cylinder at one end and connected to a cam member that pivots the rocker lever about the support shaft at the other end. The reset valve assembly is housed in a passage of the rocker lever and the passage is in flow communication with a slave piston coupled to the exhaust valve. The passage is also in flow communication with a fluid supply and a reset valve assembly opens and closes the passage with a reset pin. In a compression braking mode of operation, the cam surface of the support shaft contacts one end of the reset pin and rotation of the rocker lever around the support shaft causes movement of the end of the reset pin along the cam surface. This movement positions the reset valve assembly to close the passage and isolate the slave piston from the fluid supply.

In one embodiment, one end of the reset pin rides the cam surface of the support shaft to displace the reset pin along the passage to open and close the reset valve assembly. In one refinement of this embodiment, the reset valve assembly includes a reset ball that is positionable with the reset pin to open and close the passage and one end of the reset pin is in contact with the reset ball. In a further refinement, the reset ball is spring biased toward the second end of the reset pin.

In another embodiment, closing the reset valve assembly traps fluid in the slave piston to maintain the exhaust valve in an open position for compression braking. In a further embodiment, the cam surface of the rocker lever support shaft includes a concave and a convex portion. One end of the reset pin contacts the concave portion when the reset valve assembly is in a closed position and the end of the reset pin contacts the convex portion when the reset valve assembly is in an open position. In yet a further embodiment, the reset valve assembly is normally locked in the open position with a detent mechanism when the compression mode of braking is off.

In one embodiment, the support shaft includes a cylindrical body and the cam surface is formed in an outer surface of the cylindrical body. In another embodiment, the passage includes a first portion between the reset valve assembly and the slave piston and a second portion that houses the reset pin. A fluid supply passage extends from the second portion of the passage to a fluid supply. In one refinement of this embodiment, there is a receptacle in the rocker lever that houses a detent locking mechanism that locks the reset pin and a second fluid supply passage between the receptacle and a fluid supply to unlock the detent mechanism from the reset pin.

According to another aspect, the system comprises a compression relief brake apparatus with a rocker lever pivotally mounted on a support shaft with a cam surface and a reset valve assembly. The rocker lever is connected to an exhaust valve of an internal combustion engine cylinder at one end and connected to a cam member that pivots the rocker lever about the support shaft at the other end. The reset valve assembly is housed in a passage of the rocker lever and the passage is in flow communication with a slave piston coupled to the exhaust valve. The passage is also in flow communication with a fluid supply and a reset valve assembly opens and closes the passage with a reset pin. A detent mechanism has a position in engagement with the reset pin to lock the reset valve assembly in an open position when compression mode of braking is off and in a second position disengaged with the reset pin when compression mode of braking is on to allow movement of the reset pin within the passage. In a compression braking mode of operation, the cam surface of the support shaft contacts one end of the reset pin and rotation of the rocker lever around the support shaft causes movement of the end of the reset pin along the cam surface. This movement positions the reset valve assembly to close the passage and isolate the slave piston from the fluid supply.

In one embodiment, one end of the reset pin rides the cam surface of the support shaft to displace the reset pin along the passage to open and close the reset valve assembly. In another embodiment, the reset valve assembly includes a reset ball that is spring biased toward contact with the end of the reset pin that is not in contact with the cam surface. In a further embodiment, the detent mechanism is housed in a receptacle of the rocker lever that is in fluid communication with a control fluid. In one refinement of this embodiment, the detent mechanism includes a ball member spring biased into engagement with a recess in the reset pin when compression braking mode is off to maintain the reset valve assembly in an open position. In a further refinement, control fluid is provided to the receptacle to force the ball member out of the recess to unlock the reset pin in the compression braking mode of operation.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A compression relief brake apparatus, comprising:

a rocker lever pivotally mounted on a support shaft, said support shaft having a cam surface;

one end of said rocker lever operably connected to at least one of an exhaust valve or an exhaust valve crosshead of an internal combustion engine cylinder and an opposite end of said rocker lever operably connected to a cam member that pivots said rocker lever about said support shaft;

a reset valve assembly housed in a passage of said rocker lever that is in flow communication with a slave piston coupled to said exhaust valve, said passage further being in flow communication with a fluid supply, said reset valve assembly including a reset pin positionable to open and close said passage with said reset valve assembly; and wherein in a compression braking mode of operation said cam surface of said support shaft contacts a first end of a reset pin and rotation of said rocker lever around said support shaft causes movement of said first end of said reset pin along said cam surface to close said passage with said reset valve assembly and isolate said slave piston from said fluid supply.

2. The apparatus of claim 1, wherein said first end of said reset pin rides the cam surface of said support shaft to displace said reset pin along said passage to open and close said passage with said reset valve assembly.

3. The apparatus of claim 2, wherein said reset valve assembly includes a reset ball that is positionable with said reset pin to open and close said passage and a second end of said reset pin is in contact with said reset ball.

4. The apparatus of claim 3, wherein said reset ball is spring biased toward said second end of said reset pin.

5. The apparatus of claim 1, wherein closing of said reset valve assembly traps fluid in said slave piston to maintain said exhaust valve in an open position for compression braking.

6. The apparatus of claim 1, wherein said cam surface includes a concave portion and a convex portion, and said first end of said reset pin contacts said concave portion when said reset valve assembly is in a closed position and said first end of said reset pin contacts said convex portion when said reset valve assembly is in an open position.

7. The apparatus of claim 1, wherein said reset valve assembly is normally locked in the open position with a detent mechanism when the compression mode of braking is off.

8. The apparatus of claim 1, wherein said support shaft includes a cylindrical body and said cam surface is formed in an outer surface of said cylindrical body.

9. The apparatus of claim 1, wherein said passage includes a first portion between said reset valve assembly and said slave piston, a second portion housing said reset pin, and further comprising a fluid supply passage extending from said second portion of said passage to said fluid supply.

10. The apparatus of claim 9, further comprising:

a receptacle in said rocker lever that houses a detent locking mechanism that locks said reset pin; and a second fluid supply passage between said receptacle and said fluid supply to supply a fluid for unlocking said detent mechanism from said reset pin.

11. A compression relief brake apparatus, comprising:

a rocker lever pivotally mounted on a support shaft, said support shaft having a cam surface;

one end of said rocker lever operably connected to at least one of an exhaust valve or an exhaust valve crosshead of an internal combustion engine cylinder and an opposite end of said rocker lever operably connected to a cam member that pivots said rocker lever about said support shaft;

a reset valve assembly housed at least in part in a passage of said rocker lever that is in flow communication with a slave piston coupled to said exhaust valve, said passage further being in flow communication with a fluid supply, said reset valve assembly including a reset pin positionable to open and close said passage with said reset valve assembly; and a detent mechanism having a first position in engagement with said reset pin to lock said reset valve assembly in an open position when a compression mode of braking is off and a second position disengaged with said reset pin during a compression mode of braking to allow movement of said reset pin in said passage, wherein in said compression mode of braking said cam surface of said support shaft contacts a first end of said reset pin to control movement of said reset pin to close said reset valve assembly and trap fluid in said slave piston to open the exhaust valve during compression braking.

12. The apparatus of claim 11, wherein said first end of reset pin rides the cam surface of the support shaft to displace said reset pin along said passage to open and close said reset valve assembly.

13. The apparatus of claim 11, wherein said reset valve assembly includes a reset ball that is spring biased toward contact with a second end of said reset pin.

14. The apparatus of claim 11, wherein said detent mechanism is housed in a receptacle of said rocker lever that is in fluid communication with a control fluid.

15. The apparatus of claim 14, wherein said detent mechanism includes a ball member that is spring biased into engagement with a recess in said reset pin when said compression braking mode of operation is off to maintain said reset valve assembly in an open position.

16. The apparatus of claim 15, wherein said control fluid is provided to said receptacle to force said ball member out of said recess to unlock said reset pin in said compression braking mode of operation.

* * * * *